United States Patent [19]

David

[11] Patent Number: 4,671,189

[45] Date of Patent: Jun. 9, 1987

[54] NUCLEAR WAR GROUP SURVIVAL: STRUCTURES AND CAMP SITE

[76] Inventor: Constant V. David, 4952 Field St., San Diego, Calif. 92110

[21] Appl. No.: 593,532

[22] Filed: Mar. 26, 1984

[51] Int. Cl.[4] ..... E04H 9/04

[52] U.S. Cl. ..... 109/15; 52/169.6; 376/309; 376/316

[58] Field of Search ..... 109/15; 52/169.6; 405/128; 252/631, 633; 376/309, 316, 310

[56] References Cited

U.S. PATENT DOCUMENTS

| | | | |
|---|---|---|---|
| 2,897,668 | 8/1959 | Graham | 109/15 |
| 3,075,448 | 1/1963 | Cohen | 109/15 |
| 3,159,118 | 12/1964 | Rosenfeld | 109/15 |
| 3,660,951 | 5/1972 | Cadwell | 109/15 |
| 4,192,629 | 3/1980 | Hallenius | 405/128 |
| 4,374,024 | 2/1983 | Peloquin | 252/631 |
| 4,496,519 | 1/1985 | McGuire | 376/316 |

*Primary Examiner*—John E. Murtagh

[57] ABSTRACT

Structures are constructed and arranged on a camp site to provide shelter to evacuees seeking survival, as a GROUP, in case of a nuclear attack on or near their city. The construction, disposition, arrangement and shapes of the structures are such that people inside these structures are not affected by the blast of the nuclear explosion, for peak overpressure levels well above those which conventional structures cannot survive. The structures and the camp site are equipped to provide the elimination of fallout dust in a short time so as to bring the total exposure of the evacuees to radioactivity levels low enough to be safe, until the radioactivity within miles has decayed down to levels acceptable for long time exposure. The sheltering structures are interlinked to provide a quasi normal indoor way of life during the period of necessary confinement of the evacuees, so that no evacuee feels the urge to leave the protection provided within the compound against the surrounding grounds radioactivity. The compound configuration is set up to provide the maximum effectiveness for defense against any marauding gangs, until protection can be secured from the police authorities in charge. The size and the implementation for autonomous survival of the camp site are such that no support from the outside world is required for a period of up to several weeks. The overall camp site set up is also such that peacetime and economical use of the camp facilities and amenities can be made, when it is not utilized as survival camp, which, of course, is the most fervent hope of everyone.

10 Claims, 41 Drawing Figures

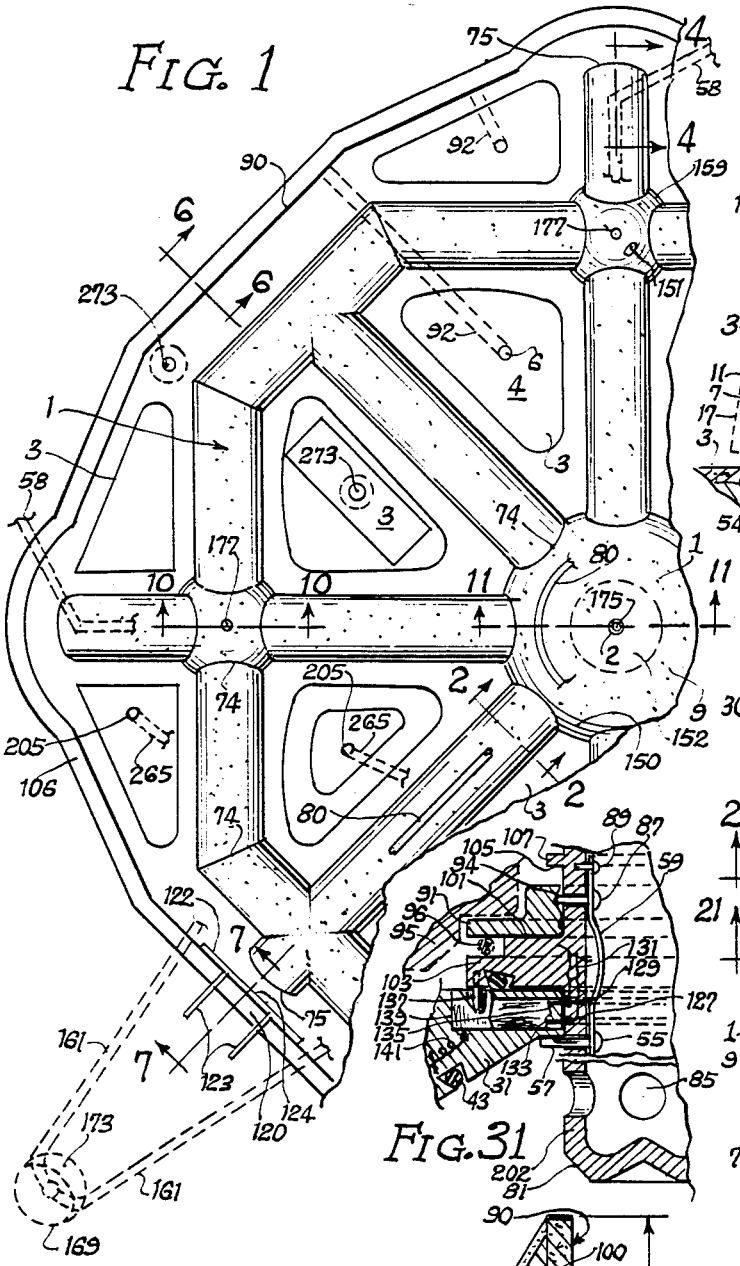
FIG. 1
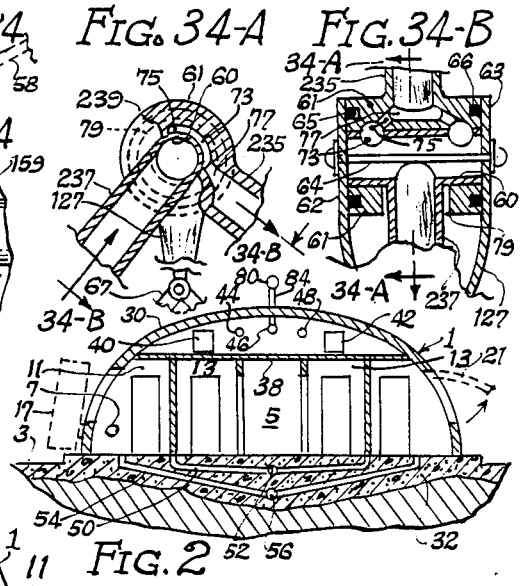
FIG. 34-A
FIG. 34-B
FIG. 2
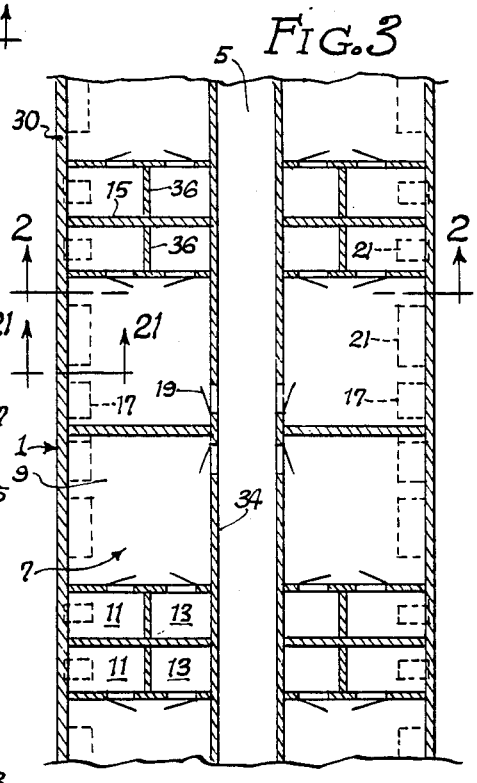
FIG. 3
FIG. 31
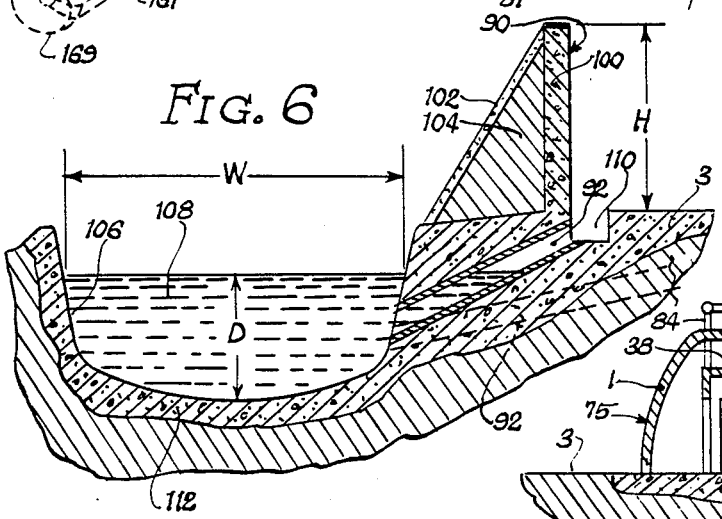
FIG. 6
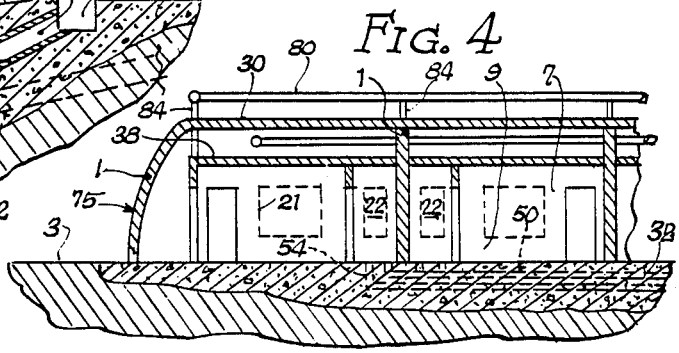
FIG. 4

FIG. 11
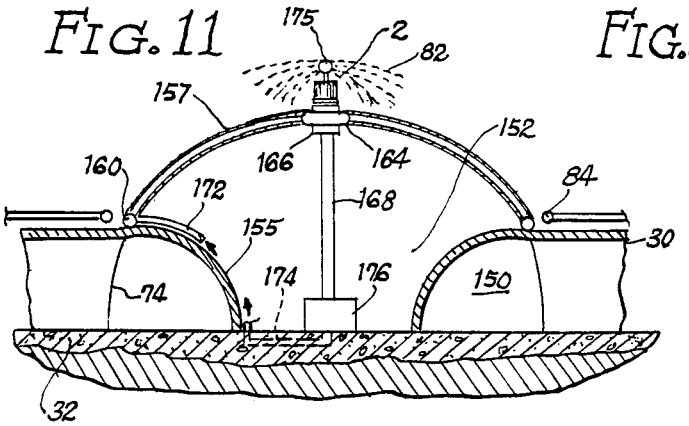
FIG. 37
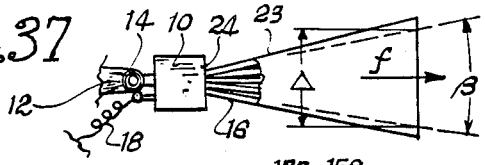
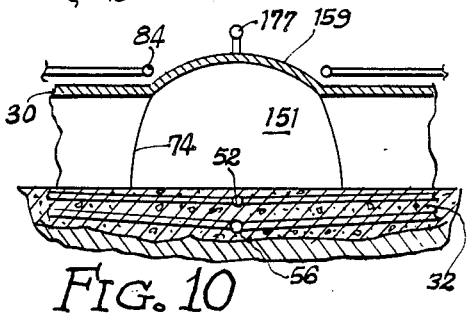
FIG. 10
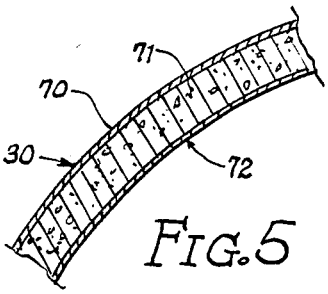
FIG. 5
FIG. 13
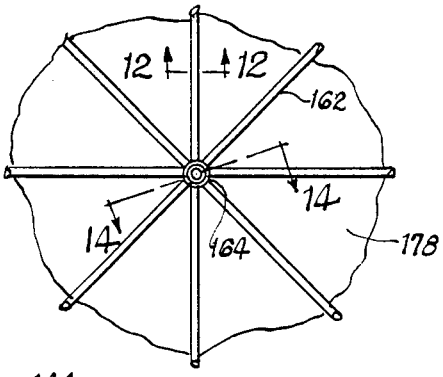
FIG. 12
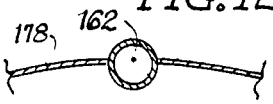
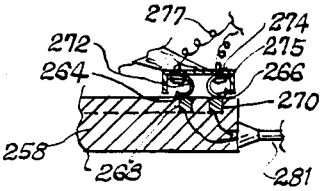
FIG. 19
FIG. 8
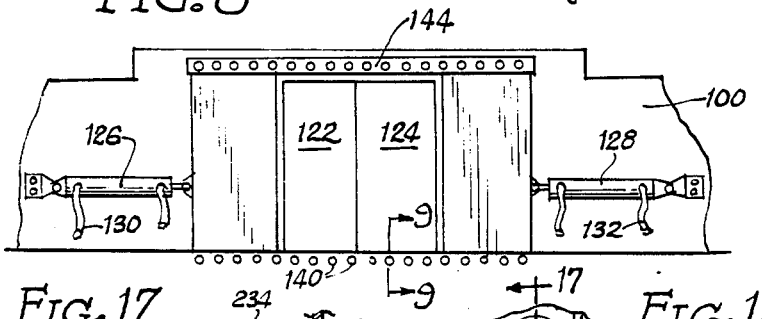
FIG. 9
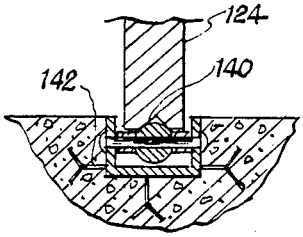
FIG. 17
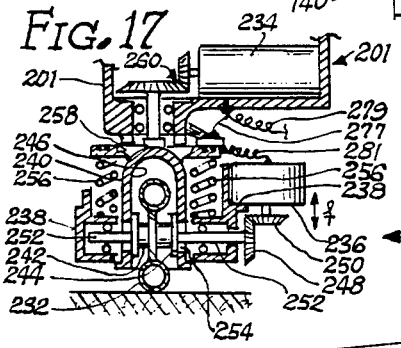
FIG. 18
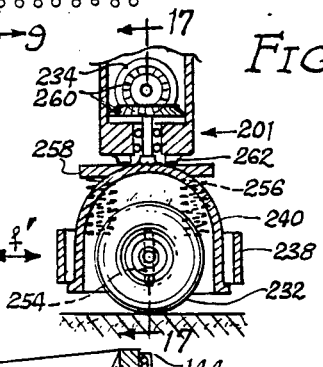
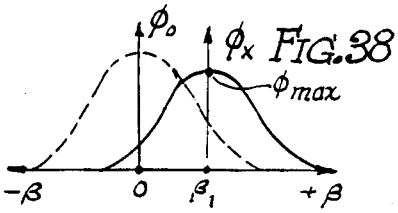
FIG. 38
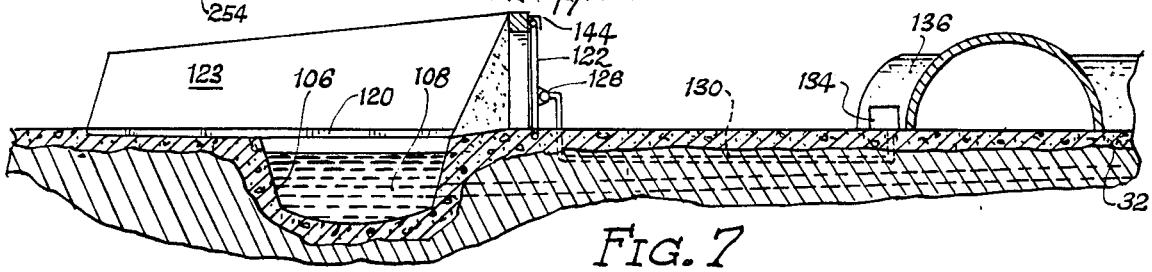
FIG. 7

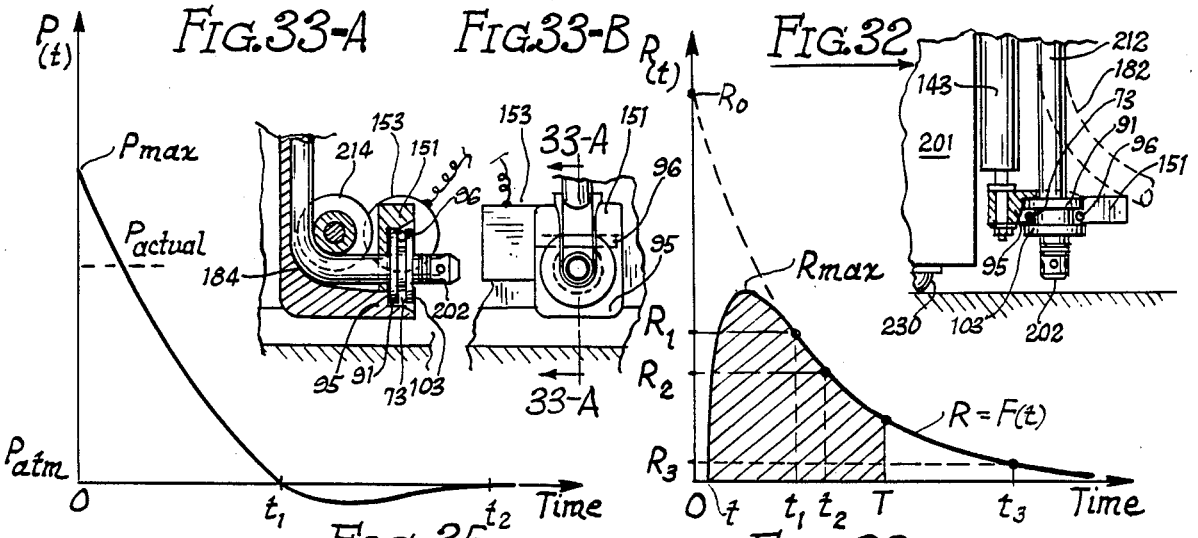
FIG. 35
FIG. 36
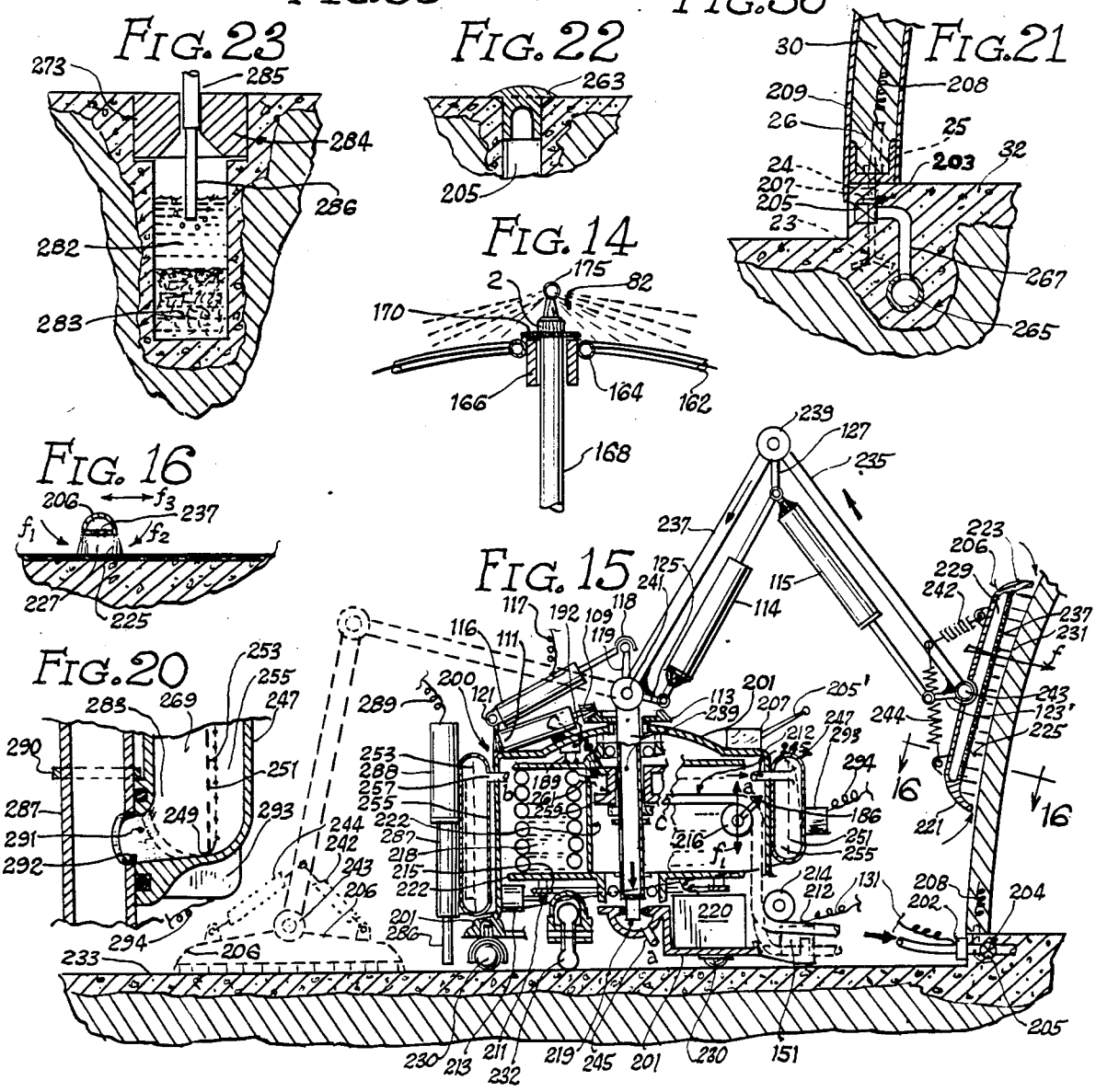

FIG. 24
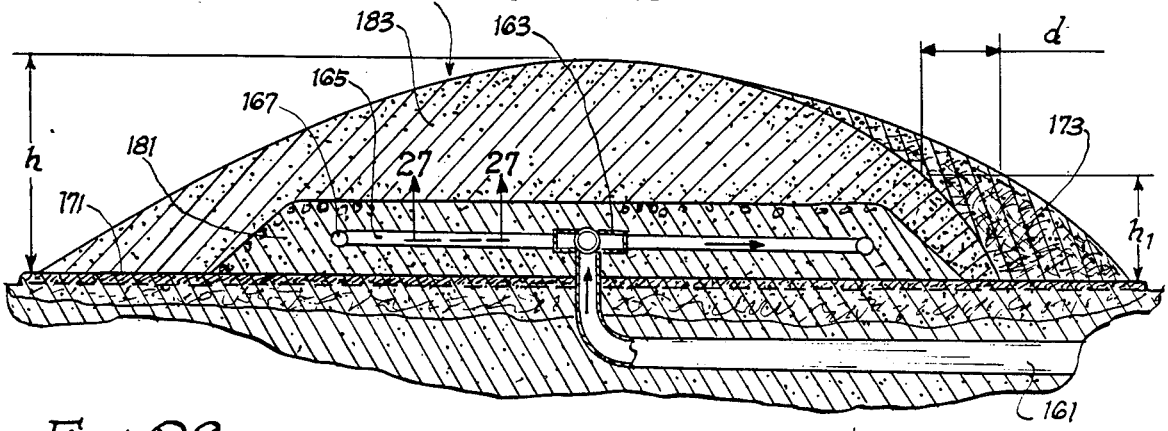
FIG. 26
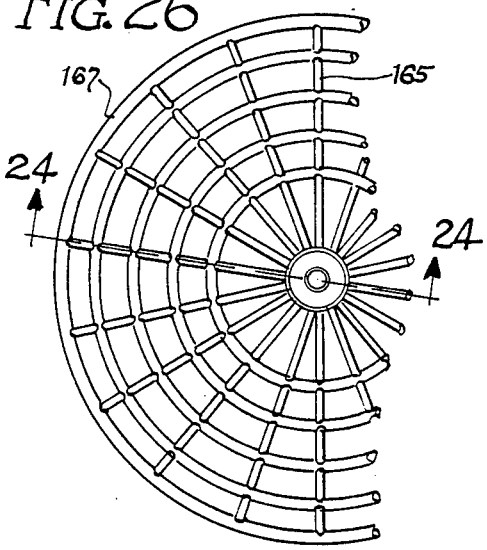
FIG. 27
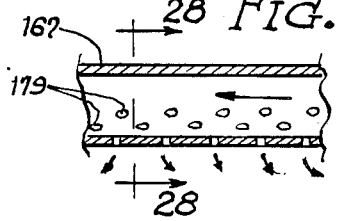
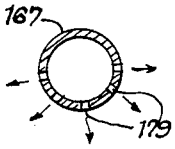
FIG. 28
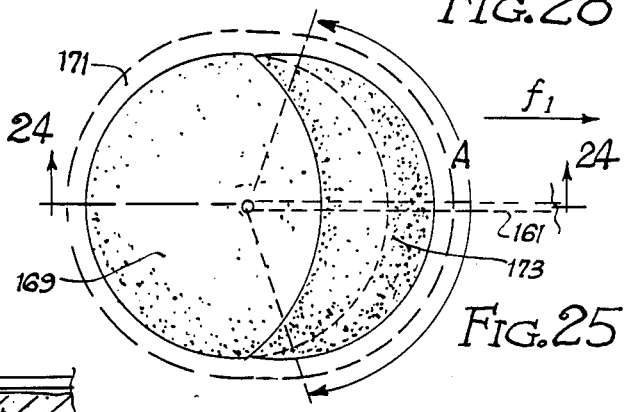
FIG. 25
FIG. 29
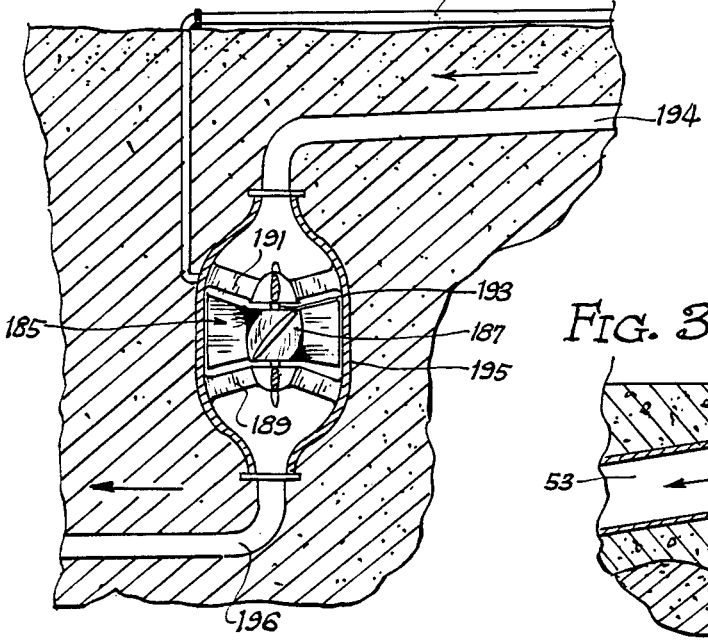
FIG. 30-B
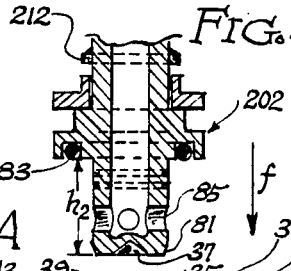
FIG. 30-A
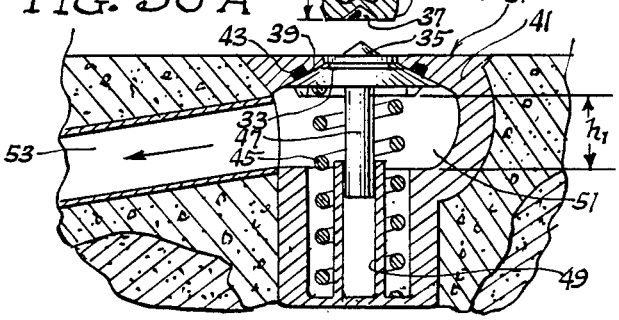

NUCLEAR WAR GROUP SURVIVAL: STRUCTURES AND CAMP SITE

BACKGROUND OF THE INVENTION

The present invention relates to the protection of civilian populations of large cities against the effects of nuclear weapons, should a nuclear war occur.

Ever since the late 1950's, when the danger of a nuclear attack upon civilian population centers began to materialize, the protection of such population, to assure its long term survival under acceptable conditions, has become a problem of enormous magnitude. More recently, because of the increased capability of potential enemies to deliver such weapons with an awesome accuracy, in large quantities, the survival of our civilization has even become questionable on a global scale.

In the continental United States, no practical plans, no well prepared hosting areas even exist to receive and care for the civilians and officials who are willing to attemp to survive, at their own cost if need be. To assure the healthy survival of those who wish to be able to go through a nuclear holocaust unhurt, three conditions must be met: (1) Put distance between the explosion and the survivors-to-be, (2) Have time to wait, while being protected (if there is any fallout), and finally (3) Have shelter, supplies, facilities, amenities and talent to help and assist these aspiring survivors for a time period of up to several weeks (if there is fallout). This can best be achieved through and coordinated efforts of all the members of a large group of people, well integrated and diversified in terms of abilities, talents and experience.

It is therefore desirable to plan, develop and implement the establishment of camp sites, the construction of structures, the setting up of equipments and facilities in advance and to have them ready to be occupied and to operate, should the need for population evacuation suddenly arise. Conventional buildings are neither designed, equipped, arranged, oriented nor constructed to provide adequate protection, even when located 35–40 miles from a one-mile altitude 20-MT nuclear explosion. Preferable, such developments should be made possible at costs and in times small enough to be meaningful. Also, it is preferable that such camp sites and the structures thereon be usable at all times for the enjoyment and benefit of those who so wish at cost, for obvious economical and maintenance reasons.

SUMMARY OF THE INVENTION

It is therefore a primary object of the present invention to provide a camp site, structures, amenities and facilities to those who, as a group, wish to attempt to survive a nuclear attack on or near their city.

It is another object of the present invention to provide equipment, managerial and technical staffing to the evacuees, to maximize their chances of meaningful survival.

It is another object of the present invention to provide assistance, food, supplies and medical care to the evacuees in a manner such that they survive physically and mentally healthy so that they, in turn, are in a condition to assist those less fortunate who are in need, outside the camp, later on.

It is another object of the present invention to provide education, instruction and training to potential evacuees prior to an emergency so that evacuees are better prepared to accept and to live through the ordeal of attempting to survive.

It is another object of the present invention to provide the means for detecting, monitoring and readying for a nuclear explosion and its effects on the camp and its occupants.

Accordingly, the present invention provides structures to resist blast, equipment and installations to wash off or clean vacuum fallout dust, facilities to care for the evacuees and attending personnel to keep them physically and mentally healthy. Preferably, this is accomplished within 25 to 35 miles from likely target points, and on a scale large enough to accommodate a minimum of several hundred individuals in each camp.

DESCRIPTION OF THE DRAWINGS

FIG. 1 is a partial plan view of the building and grounds layout of the camp site.

FIG. 2 is a sectional view taken along line 2—2 of FIGS. 1 and 3.

FIG. 3 is a partial view of the floor plan of the residential section of the building.

FIG. 4 is a partial midsectional elevation view taken along line 4—4 of FIG. 1.

FIG. 5 is a partial sectional view of a typical structural rigid wall.

FIG. 6 is a partial sectional view of the mast and protection wall taken along line 6—6 of FIG. 1.

FIG. 7 is a partial sectional view taken along line 7—7 of FIG. 1, of the moat, the protection wall and the bridge.

FIG. 8 is a partial elevation view of the wall and gate assembly seen from inside the camp.

FIG. 9 is a detailed partial cross-sectional view of the bottom part of the gate guiding system.

FIG. 10 is a partial midsectional elevation view of a typical building junction taken along line 10—10 of FIG. 1.

FIG. 11 is a partial midsectional elevation view of the central structure taken along line 11 of FIG. 1.

FIG. 12 is a detailed partial sectional view of the central dome wall taken along line 12—12 of FIG. 13.

FIG. 13 is a partial top view of the central dome cover.

FIG. 14 is a detailed partial sectional view taken along line 14—14 of FIG. 13.

FIG. 15 is a combined midsectional elevation and external view of the vacuum cleaning robot.

FIG. 16 is a partial sectional view taken along line 16—16 of FIG. 15.

FIG. 17 is a detailed partial midsectional side elevation view of the cleaning robot driving wheel taken along line 17—17 of FIG. 18.

FIG. 18 is a detailed partial midsectional elevation view of the cleaning robot driving wheel.

FIG. 19 is an enlarged detailed sectional view of the robot driving wheel electrical slip switching mechanism.

FIG. 20 is an enlarged detailed sectional view of the dust evacuation tube of the cleaning robot.

FIG. 21 is an enlarged detailed sectional view of the anchoring system of the rigid structure wall.

FIG. 22 is a partial sectional view of the ground-embedded vacuum tube connection and closing cap.

FIG. 23 is a midsectional elevation view of a fallout dust dumping well.

FIG. 24 is a midsectional elevation view of a sand mound trap for fallout dust, taken along line 24—24 of FIG. 25.

FIG. 25 is a top view of a sand mound trap.

FIG. 26 is a schematic layout of the fallout dust disposing pipes inside the sand mound trap.

FIG. 27 is a midsectional elevation view of a fallout dust disposing pipe taken along line 27—27 of FIG. 24.

FIG. 28 is a sectional view taken along line 28—28 of FIG. 27, of a fallout dust disposing pipe in a sand mound.

FIG. 29 is a midsectional elevation view of the central vacuum powering system.

FIG. 30-A is a detailed midsectional elevation view of a ground vacuum tube connection.

FIG. 30-B is a detailed midsectional elevation view of the end conection of a cleaning robot evacuation tube.

FIG. 31 is a detailed partial midsectional elevation view of the end of a vacuum tube, shown engaged and locked into a ground-embedded vacuum tube connection.

FIG. 32 is a partial side elevation view of the actuating means of the fallout dust tube connecting end, for ground use.

FIG. 33-A is a detailed partial midsectional view of the fallout dust tube connection end for wall connection, taken along line 33-A—33-A of FIG. 33-B.

FIG. 33-B is a side elevation view of the fallout dust tube end for wall connection.

FIG. 34-A is a detailed partial midsectional elevation view of a typical vacuum robot tube articulation taken along line 34-A—34-A of FIG. 34-B.

FIG. 34-B is a detailed partial sectional view taken along line 34-B—34-B of FIG. 34-A.

FIG. 35 is diagram curve showing how the shock wave pressure varies with time as the shock wave passes by.

FIG. 36 is a diagram curve showing how a typical fallout radiation level decays with time.

FIG. 37 is a diagrammatic view of a sensing device for detecting a nuclear explosion at a distance.

FIG. 38 is a diagram curve showing how the light flash from a nuclear explosion varies as the viewing angle deviates from the exact line of sight.

DETAILED DESCRIPTION OF THE INVENTION

Referring to FIGS. 1 to 4, the nuclear war group survival camp site generally comprises a plurality of structures 1 erected on pre-improved grounds 3 to provide shelter and living accommodations to a group of people. Within a complex, structures 1 are interconnected by corridors 5 in a manner such that living quarters 7 communicate with common quarters 9, centrally located so that the occupants need not leave the shelter means provided by structures 1, in case of emergency. An emergency condition exists when a nuclear attack is anticipated and after it has occured, as long as the surroundings outside structures 1 present some health hazard. Living quarters 7 generally include a residence room 9, a bathroom 11 and closet space 13 located back to back on each side of separation walls 15, between two adjacent living quarters 7. Living quarters 7 are arranged on each side of corridors 5 and can be entered through two doors 17 and 19. Access door 17 opens on the outside, entrance door 19 opens into corridor 5. In case of emergency, only doors 19 are to be used and doors 17 are locked. Windows 21 and 22 provide light and fresh air to residence rooms 9 and bathrooms 11. Under emergency conditions, all windows are also locked. All access doors and windows are equipped with locking means, not accessible to the occupants, but monitored and controlled only by management.

All structures housing the occupants' living quarters are constructed to provide an outer shell 30 anchored to foundations 32 and solidly attached to all internal walls 15, 34 and 36 which support ceilings 38 over the living quarters and corridors. All fresh air ducts 40, air conditioning ducts 42, electrical conduits 44, cold water pipes 46 and communication lines 48 are located in the space provided between ceilings 38 and the upper part of outer shell 30 which also plays the role of a conventional roof. Hot water pipes and used water pipes are located inside ducts 50 which service each living quarter and that are connected to a central duct 52 connecting all living quarters. A plurality of sewer pipes 54 connect each bathroom to a sewer duct 56 that connects all individual sewer pipes to central sewer disposal connections 58. The sewage is disposed of by conventional means: septic tanks, leach fields or sewage processing plant as is most desirable for each camp site. Outer shells 30 are built to withstand external air pressures well in excess of the air pressure inside the living quarters. To that effect, structural shell 30 presents no flat surface, to avoid local buckling, and structural integrity throughout its thickness, as shown in FIG. 5 in which a partial section of the outer shell is depicted. Two concentric thin shells 70 and 72 made of strong materials are affixed on both sides of a light density core material 71 to form the sandwiched thicker shell. This structural shell is continuous throughout a whole complex, except where openings are required for doors, windows and connections such as 74 to other outer shells within the complex. Other complexes can be located in the vicinity and all interconnected to that which is described herein and between themselves, either underground or by above ground tunnels constructed in a similar fashion. Ends of outer shell structures such as 75 are terminated by partially ellipsoidally shaped shells to provide strength, as explained earlier.

Along the centerline of each outer shell and above the shell top, water pipes 80 are provided to feed a continuous network of sprinklers 82 arranged to reach all open surfaces within a complex as defined by outer perimeter line 90. All surfaces of both structures and ground can thus be washed. The used washing water is evacuated by gravity through underground ducts such as 92 outside of perimeter 90. The sprinkler system receives its water through feed lines 84 connected to cold water supply lines such as 46. Each complex or group of complexes is surrounded by a wall 100 of height H ranging from 8 to 10 ft. It is backed on the outside by abutting shell 102 with inner volume 104 being filled with dirt. The inner surface of wall 100 is the complex perimeter line 90. On the outer side of wall 100, a moat 106 runs the length of perimeter 90, and of wall 100, and is filled with water 108 to a depth D and over a width W. The moat has a threefold purpose, to act as a: a reservoir for the washing water, a dump for the radioactive washed off dust and a natural defense barrier. Wall 100 has a twofold purpose: to shield the occupants from radiations coming from outside the camp site and to offer another natural defense barrier. A gutter 110 runs along wall 100 to help evacuate the runoff water in addition to ducts 92 that collect water mostly inside enclosed patios areas 4 between the structures (collection points 6). The wall of moat 106 has a concrete shell 112 designed to minimize the loss of water into the ground. Access to the camp site is through bridges 120 that have side walls 123 for protection and to act as additional radiation shields. The entrance into the camp site is through wall 100 by means of sliding double gates 122 and 124, actuated by hydraulic actuators 126 and 128. The actuating hydraulic fluid comes through underground lines 130 and 132 from a pump and control means 134 housed at the end of the closest structure in a service room 136. Gates 122 and 124 roll on a plurality of spheres 140 mounted and centered in a U-shaped track 142 anchored in the ground concrete. The track is part of gate frame 144 that is solidly attached to wall 100, on the internal surface of that wall, as shown in FIGS. 7–9.

Referring to FIGS. 1 and 10 to 14, the central part of each complex houses the main service areas 150 and a quasi "open sky" dome 157, over the common area 152 which is used by the occupants for various every day activities. The structures protecting the service and common areas are of two basically different types: the rigid semi-toroidal structure 155 and the dome flexible wall structure 157. When subjected to external pressure, the rigid structure resists and hardly deforms, the flexible structure yields and deforms appreciably, but comes back to its original shape without breaking. It is practical to build rigid structures of the size of the outer shells to withstand differential pressures of a few pounds per square inch (psi). However, it is not practical (economical) to build rigid structures of a much larger size, such as that of dome 157, especially when not needed as is discussed later. The rigid hemishperical structures such as 159 connecting the living quarter structures 1 can also be constructed like outer shell 1, because their dimensions are not much larger than those of outer shell 1. These hemispheres shelter additional service areas and spaces 151. Flexible dome structure 157 of FIGS. 11 to 14 comprises anchoring rigid hollow ring 160 connected to hollow ribs 162 which join together at the top through rigid hollow torus 164 mounted on sliding sleeve 166. Sleeve 166 can slide on mast 168 up to a fixed height determined by top flange 170 solidly attached to mast 168. Torus 164, ribs 162 and hollow ring 160 all communicate and are pressurized by compressed air through air line 172 connected by air line 174 to an air compressor housed in space 176 located at the foot of mast 168. A transparent flexible plastic membrane 178 is stretched between ribs 162 and anchoring ring 160 which is solidly attached to the outer wall of the semi-toroidal rigid structure 155. Mast 168 contains a water feed line that brings water under pressure to ball sprinkler 175. Similar ball sprinklers 177 are also located at the top of hemishperical domes 159.

Because of either camp site geographical location or the fact that a nuclear attack can take place at any time of the year, the outside temperature could very well be below freezing should a case of emergency arise. Washing off the radioactive fallout dust with water is then impossible. Antifreeze, or some salt, could be added to the water to alleviate this problem. However, an alternate back up system should be provided, in the case of most camp sites, with means of removing the dust off all external and ground surfaces, within wall 100 perimeter. Means must also be provided to deposit or trap this radioactive dust in a manner such that its radioactivity presents no danger, until it has decayed below a safe level. Vacuum cleaning means are provided as presented in FIG. 15 by robot vacuum cleaner 200, remotely controlled by radio and monitored to do the following: move in all directions, engage and disengage quick connect/disconnect vacuum tube insert 202 and electrical plugs 204, operate a vacuum cleaning brush and apply it against all surfaces to be cleaned, filter and store the radioactive dust, dump this dust in specially prepared dumping wells; all this without the need of a human operator nearby. The robot, when plugged in, is powered by electrical current brought in by electrical lines 208, connected to the camp power plant and to electrical female plug 203. Electrical lines 208 are connected to connectors 207 attached to electrical conduit 209. When the robot is not electrically connected to the camp power plant, power is supplied by battery 220 used only for the following tasks: to move the robot from one plug-in station to another, to leave and enter buildings, to retract the vacuum tube and electrical line, to bring the robot back for inspection or repair in case of malfunction. When the vacuum system is operating, the battery is constantly being recharged and thus always kept fully charged at all times. The quick connect-/disconnect insert 202 is mounted at the end of flexible tube-electrical-conduit assembly 212 which is guided by rollers 214 and 216 into storage space 218 located inside the robot vehicle body. Inside robot 200, revolving drum 222 stores conduit assembly 212 and always maintains a slight tension on the conduit assembly to keep it taut between the robot and the quick connect/disconnect plug, at all times. Drum 222 is actuated by slip roller 211 powered by electrical motor 213. Slip roller 211 applies torque on circular flat tracks 215 mounted on the bottom of drum 222. The length of conduit 212 wound on drum 222 is sufficient to permit brush 206 to reach any and all surfaces, within the camp site, from at least two quick connect/disconnect stations, so that all areas within the boundaries of wall 90 can be swept clean. When the area within the reach of a station has been vacuummed, insert 202 is disconnected and the robot proceeds to the next station where insert 202 is then connected. The connecting and disconnecting actions of insert 202 are accomplished by means of the robot motion in the case of wall plugs. Ground plugs are reached by a monitored vertical motion of insert 202, as described later. All ground areas within wall 90 boundaries are flat and without steps or surface irregularities that could immobilize the robot or make it difficult to be swept. Several robots are available and can be used simultaneously in one camp site.

FIG. 15 schematically describes how robot vehicle 201 is supported and propelled: by means comprising three casters that support a large part of the vehicle weight. One single driving wheel 232 supports the balance of vehicle 201 weight and is used for steering the robot. Details of driving wheel 232 actuation, presented in FIGS. 17 and 18, include steering motor 234, driving motor 236 mounted on frame 238, rotatable wheel bracket 240 that contains wheel 232 and guides wheel assembly 242. This assembly comprises two circular flanges 244 maintained by and sliding on two flat surfaces 246 located inside bracket 240, a bevel gear 248 driven by bevel gear 250 powered by motor 236, and wheel axle 252 which can rotate with respect to frame 238. The whole assembly of the driving wheel, its driving motor, its vertically guiding flanges and frame 238 are free to move up and down, relative to bracket 240, within the range of vertical motion allowed by slots 254 located on each face of bracket 240. A set of support springs 256 located between frame 238 and horizontal flange 258 solidly attached to the top of bracket 240, provides the balance of the support for vehicle 201 weight, as earlier mentioned. The springs and the vertically allowed motion of wheel assembly 242 insure that positive contact always exists between driving wheel 232 and the ground. Bevel gears 260 transmit the steering torque to the driving wheel, between motor 234 and bracket 240. The total force reacted by the ground on driving and steering wheel 232 through springs 256 is directly transmitted to vehicle frame 201 by means of sliding pads 262 that are in contact with flange 258. Position feedback is provided within motor 234 so that the operator knows the driving wheel angular position at all times. Bracket 240 can rotate 360 degrees and electrical power must be provided to motor 236 for any and all steering wheel angular positions, and for any and all vertical positions of motor 236. This is achieved by means of sliding electrical contacts 264 and 266 that include circular collecting rings 268 and 270 embedded in the top surface of flange 258, on which spring brushes 272 and 274 contained inside box 275 can slide. Spring brushes 272 and 274 are connected to electrical leads 277, themselves connected to main electrical line 279 of FIG. 17. Flexible electrical conduit 281 supplies power to motor 236. Arrows f and f' indicate directions.

The commands sent to the vacuum cleaner are all radioed in and received through antenna 205' mounted on radio receiver 207 box, attached to vehicle 201. One of these command signals is for the operation of cleaning brush 206 which must be applied squarely against any surface to be cleaned, be it flat or curved. Brush 206 is pushed against such surfaces as 231 and 233 by articulated arm 235 connected to arm 237 through cylindrical joint 239. Arm 237 is articulated at the top and center of vehicle 201, on cylindrical joint 241. The end of articulated arm 235 holds cleaning brush 206 body by means of articulated cylindrical joint 243. Tension springs 242 and 244 are identical and insure that the rest position the cleaning brush body is perpendicular to arm 235, whenever the brush is not pushed against a solid surface. Any force applied against such a surface, as in the direction of arrow f, forces the brush to tilt so that lips 221 and 223 rest on that surface, flat or curved. The sides of cleaning brush 206 are almost solidly covered with bristles 225. Together with lips 221 and 223, they form a quasi closed box 227, with the surface to be cleaned providing the other side of the box. This creates the suction effect needed to suck the dust set loose by the bristles. As the brush moves around, air and dust move in the directions of arrows $f_1$ and $f_2$ shown in FIG. 16. Both arms 235 and 237 are hollow tubes, connected through articulations 239, 241 and 243 in such a way that air passage is continuously maintained between collection box 229 and hollow central suction axis 239. The air and dust sucked in enter collection box 229 through a plurality of holes 237, and from there, travel to central axis 239. From central axis 239, the air-dust mixture exits at the bottom of duct 239 into collection chamber 219, from which it is led by duct 245 (connection shown by letters "a" in FIG. 15) into dust receptacle 247 mounted around vehicle 201 body, with its low point located at 249 in FIG. 20. The air is filtered by flexible filtering membrane 251 attached to the bottom and top of receptacle 247 and retained structurally by rigid screen 253, also affixed to the bottom and top of receptacle 247. The filtered clean air then passes into volume 255 from which it exits through duct 257 into a slip sealed collector 259 attached to vehicle 201 structure. The air leaves the annular chamber of collector 259 through opening 261 which lets the air into the end of duct 212 which is attached to pipe winding drum 222. The air travels the length of wound duct 212 to exit at point "c" where the wound part of duct 212 ends, then proceeds to the quick connect/disconnect insert 202. A network of vacuum ducts, with a plurality of quick connect/disconnect female receptacles 205 located in the building foundation and on the ground, as shown in FIGS. 1 and 22, is built-in throughout the camp. The quick connect/disconnect female plugs installed in the ground and other duct openings are covered by caps 263 when not in use or when no use is anticipated soon. In the building foundations, the quick connect/disconnect female receptacles communicate with the vacuum duct network through connection tubes 267. The vacuum network is connected to an air suction station located underground as shown in FIG. 29. Electrical line 131 which connects to the camp power plant by means of the electrical contacts on insert 202, is structurally part of flexible air duct 212, along the whole length of duct 212, up to the other end, at air pipe connection 261. At that point, the electrical line is connected to contact rings 189 on which electrical brushes, as shown in FIG. 19, can slide to maintain contact. The camp power plant electrical current is processed by switch-converter 192 to keep battery 220 always fully charged. All electrical motors, solenoids and actuators used for the operation of the vacuum cleaning robot and its equipment are powered by DC current supplied at the battery voltage, from the battery or directly by bypassing the battery, as the case demands.

The radioactive dust 289 collected in chamber 271 must be disposed of quickly, It can be dumped within the complex in a plurality of very deep wells 273 shown in FIG. 23 and located as far away from the buildings as possible, as indicated in FIG. 1. These dump wells, lined with concrete, contain in permanence a non-freezing liquid 282 of density lower than that of water and which can cover dumped dust 283, when in use. A shielding plug 284 always cover these wells. When no use of the wells is contemplated, access holes 285 are covered with a cap such as 263 of FIG. 22. Access hole 285 is used to introduce dump tube 286 to drop the radioactive dust 283. Dump tube 286 is located at the bottom of a collecting tube 287 actuated vertically by actuator 288 mounted on the side of dust receptacle 247 and where low point 249 of that dust receptacle is located. When volume 269 is deemed full enough, the vacuum cleaning robot positions dump tube 286 over a hole 285. A signal is sent through electrical line 289 to actuator 288 to lower dump tube 286. The collecting tube slides downward until stop 290 reaches spout 291 edge. Then hole 292 on side of collecting tube 287 registers with the spout opening. Several vibrators 293 are activated through electrical lines 294 to facilitate the evacuation of the radioactive dust 283 into spout 291. When the dumping operation is completed, collecting tube 287 is retracted and the vacuum cleaning operation can be resumed. The opening of spout 291 is then closed by the external surface of collecting tube 287, and sealed.

Referring to FIG. 15 again, the sweeping motion of cleaning brush 206 is always performed by means of a sideway movement as indicated by arrow $f_3$ of FIG. 16. The mechanism used to impose this motion onto brush 206 comprises an electrical motor 111 for rotating central axis 239 by means of bevel gears 109 and 113, two compression spring actuators that always tend to cancel the builtin jackknifing action of tubes 235 and 237, electrical actuator 116 powered through lines 117 and connected to ball joint articulation 118 at the end of lever arm 119. The other end of actuator 116 is attached to vehicle 201 structure by articulation 121 to allow some swinging motion up and down of actuator 116 as required. Lever arms 123' and 125 are solidly connected to arms 235 and 237 respectively, whereas arm lever 127 is free to rotate with respect to arms 235 and 237 so that both compression springs in actuators 114 and 115 exert about the same push to open up the angle made by arms 235 and 237.

The radioactive dust is not the only material that a vacuum cleaning system would pick up. The total amount of dust and extra material to be disposed of may be too bulky or too radioactive for the use of only wells as dumping sites. It might be advantageous and simpler to duct most of the debris outside of peripheral wall 90, far away from the camp, specially in case of heavy fallout. FIGS. 24 to 30-B illustrate an approach that includes a plurality of main ducts 161 connected to a dust distribution array 163 of perforated radial tubes 165 connected to perforated circular tubes 167, all buried inside a sand mound 169 located above elevated ground pad 171, so that rain water can drain off. The side of mound 169 facing the camp site is covered with compacted dirt 173 so that very little radioactive dust is trapped inside this dirt. It can then acts as an additional radioation shield. The camp site is located in the direction of arrow f of FIG. 25 and angle A encompasses the view of the camp as seen from the center of mound 169. The perforation holes 179 are located on the bottom half of the distribution tubes 165 and 167 as shown in FIGS. 27 and 28, so that they cannot be plugged by ice. Holes 179 let the air and the dust leak downward so that the length of the air escape route is maximized. The interior volume of mound 169 is filled with loose fine gravel 181 to keep sand 183 from clogging holes 179 or from getting inside tubes 165 and 167 when the system is not used. In this system, the dust filtering, storing and dumping means of the vacuum cleaning robot are not used. Referring to FIG. 15, the end of central axis 239 is connected to slip sealed collecting annular chamber 261, because duct 245 is almost directly connected to the end of duct 212 on drum 222. Such a vacuum system is less prone to clogging and can be used uninterruptedly, saving time and thereby reducing the total exposure by the camp occupants to radiations. The air vacuum and pumping station is shown in FIG. 29. It comprises a multivaned compressor 185 powered by motor 187 connected to electrical lines 188. Motor 187 is supported through vertical shaft 193 by braces 189 and 191 attached to air pump housing 195. The air-dust mixture comes in through duct 194 and leaves through duct 196 that connects to main ducts 161. A coarse filtering station (not shown), located between the camp and mounds 169 and underground, is used to stop the bulky debris, to keep tube 165 and 167 perforated holes from becoming clogged when the system is in use. A sprinkling system (not shown) located above the mounds is used to either keep the sand wet, when the system is used, or to melt ice that may have accumulated, under cold weather conditions on top of the mound, prior to starting the vacuum system, when an emergency situation has developed.

FIGS. 30-A and 30-B show a quick connection assembly that comprises male plug 202 and female plug 31, both shown ready to engage, as soon as male plug 202 is lowered in the direction of arrow f. The assembly of FIGS. 30-A and 30-B corresponds to a ground installed plug, a wall installed plug would be rotated 90 degrees as shown in FIG. 21. The position of the plug assembly (horizontal or vertical axis) does not affect its operation, all plugs are identical. The female plug includes a poppet valve, terminated by a conical tip 35 that can engage and match its counterpart: female conical cavity 37 located at the end of male plug insert 202. Poppet valve 33 rests on seat 39 of body 41 of female plug assembly 31. A seal 43, embedded in seat 39, provides air tightness and prevents water from entering the vacuum system. Poppet valve 33 is kept in the closed position by compression spring 45 located around stem 47 and its guide 49. When male plug 202 is moved against the poppet valve, matching conical surfaces 35 and 37 insure that both parts of the plug assembly, male and female, are centered with respect to each other. A chamfer 81, on the tip of male plug 202, also facilitates the engagement. When the engagement is completed, the inside of hose 212 then communicates with chamber 51 inside female plug body 41, through a plurality of holes 85, located near the tip and on the wall of male plug 202. The air is then ducted from chamber 51 by underground ducts 53 to the main vacuum duct 194. Seal 83 is then in contact with the flat face of the female plug assembly, at ground level, to prevent the introduction of extraneous air or water in the vacuum system. The poppet valve can travel a distance $h_1$, larger than the length $h_2$ of male plug 202.

FIG. 31 shows in more detail the engagement of the quick connect/disconnect plug assembly. Because spring 45 must be strong enough, in its extended position (poppet valve closed), to counteract the force exerted by the pressure differential across the poppet valve, as applied on the area determined by seal 43 contact on the poppet valve conical surface, when engaged, male plug 202 must counteract an even larger force to maintain the engagement. To that effect, a positive locking mechanism 55 comprising a plurality of locking pins 57, leaf springs 59 actuated by push pins 87, are mounted inside male plug 202 bore by means of screws 89. As movable flange 91 slides on the external surface of male plug 202, from contact 101 with main fixed flange 103 to contact 105 against collar stop 107, push pin 87 is forced to leave recess 94 and is pushed in, or let out when sliding flange 91 is pushed back down, which moves locking pins 55 in and out of their locking positions. As male plug 202 becomes fully engaged into female plug 31, electrical contacts are also established by means of conducting rings 127 and 129 connected to electrical lines 131 that lead to the vacuum cleaning robot, as earlier described. Rings 127 and 129 are electrically insulated from male plug 202 wall material. Two spring loaded electrical brushes 133 and 135 make contacts with rings 127 and 129 when male plug 202 is engaged. When flange 103 is lowered, it pushes stem 137 of switch 139, which then establishes contact between brushes 133 and 135, and live electrical line 141 that is connected to the camp power source. The vacuum cleaning robot then switches from battery operation to camp power operation.

Referring to FIGS. 32, 33-A and 33-B, shown are the actuating means for lowering male plug 202, which comprise an actuator 143 mounted on robot frame 201, a guiding fork 151 that extends outward from flange 91 holder 95, a locking pin 96 actuated by solenoid 153 mounted on the side of fork 151. In the case of a horizontally positioned plug assembly, as shown in FIGS. 33-A and 33-B, actuator 143 is not needed, because vehicle 200 is used to push and pull male plug 202 in and out of engagement. To pull male plug 202 out, solenoid 153 is energized, locking pin 96 moves in between flanges 91 and 103 in the U-shaped circular groove 73, which gives a positive grasp to fork 151 on male plug 202 assembly. In the configuration of FIG. 32, when plug 202 is away from the robot vehicle, air duct 212 is free to pull away from fork 151 to assume a more compliant shape such as 182, so that minimal side forces are exerted on male plug 202, when engaged. In the configuration of FIG. 33-A, roller 214 and guide 184 assembly insure that air duct 212 is always within the guidance of fork 151. Referring back to FIG. 15, which corresponds to the configuration of FIGS. 33-A and 33-B, roller 214 is fixed, but roller 216 can move up and down as shown by arrow $f_1$ in a manner such that its motion is coordinated with the rotational movement of drum 222, so that the winding of air pipe 212 is accomplished in an orderly fashion. The mechanism used to move roller 216 vertically and coordinate its motion with that of drum 222 is not shown, being well known in the art. If the configuration of FIG. 32 is used, roller 216 moving mechanism is equipped with a guide 186, located where air tube 212 makes its 90-degree turn, thereby playing a role similar to that filled by guide 184 of FIG. 33-A.

Referring to FIGS. 34-A and 34-B, air connection and arm articulation 239 is depicted as comprising rigid air ducts (or arms) 235 and 237 that are connected by a rotatable joint that includes a hollow hub 60 located inside rotating cylinder 61, both being held together by flanges 62 and 63, which are retained by central rod 64. Seals 65 and 66 keep air leakage from the outside to a minimum. Flanges 62 and 63 support arm lever 127 that connects to spring actuators 114 and 115 of FIG. 15 by means of articulation 67 located at the free end of arm lever 127. The air connection is achieved by means of holes 73 in the wall of hollow hub 60 that open into chambers 75 inside cylinder 61 wall, and which communicate with channel 77 which is opened to the inside of rigid duct 235. A total angular motion of at least 120 degrees of arms 235 and 237 is provided by the cuts 79 in cylinder 61 to give clearance to air duct 237. The angular "length" of chambers 75 insures that the air passages are kept open for a third of a full turn.

DISCUSSION AND OPERATION OF THE INVENTION

The phenomenology of a nuclear explosion above ground level can be simply summed up as follows:

1. During a very brief period of time (microseconds), initial radiations and thermal energy are released. The energy release manifests itself in the form of light and heat. Heat, in the atmosphere, generates a shock wave. The intense light emitted may cause additional secondary sources of heat, far away from the fireball created by the initial radiations;
2. If the fireball reaches the ground, earth particles are set loose, irradiated, mixed with fission or fusion byproducts and carried upward in the column of hot air as debris. These debris will eventually fall back on earth, mostly at a distant location in the form of fallout;
3. If the nuclear weapon is detonated at high altitude, the electro-magnetic pulse generated by the interaction of the initial radiation particles with the surrounding ionized gas then can generate lasting disturbances in the propagation of other man-made electro-magnetic waves. At close range, the electromagnetic pulse can cause high voltage burts in conducting materials; and
4. At considerable distances (several miles) from the detonation point, at ground level, only three of the effects above are of primordial practical interest to potential survivors: the light, the shock wave and the fallout. The first effect provides the means to determine accurately the location and altitude of the detonation point. The second effect (at a known distance, at ground level) provides the means to determine the yield of the exploded weapon. From the type of radiations measured and their intensity, to some degree, the ratio of fission to fusion of the weapon can be estimated soon after.

To understand the practical importance and significance of the statements made in 4. above, some basic knowledge of the first effect that will determine the chance of survivability of people, at distances where people can easily survive, if adequately sheltered, must be established first. The table below gives the values of the physical parameters of interest for this discussion, as a function of weapon yield and distance. The symbols used later in the text are defined in that table for ease of understanding.

| PARAMETERS OF INTEREST | DISTANCE FROM EXPLOSION (miles) | | | | | | |
|---|---|---|---|---|---|---|---|
| | 1.2 | 3.25 | 6 | 16 | 24 | 45 | 65 |
| Weapon Yield (W) in megatons | 1 | 20 | 1 | 20 | 1 | 20 | 20 |
| Peak Overpressure (P) in lbs/in$_2$ (psi) | 30 | 30 | 1.7 | 1.7 | .46 | .61 | .46 |
| Front Wave Velocity (V) in ft/sec | 1950 | 1950 | 1150 | 1150 | 1050 | 1060 | 1050 |
| Wind Velocity (U) in ft/sec | 1000 | 1000 | 73 | 73 | 23 | 28 | 23 |
| Time of Arrival of Shock Front ($t_1$) in seconds | 1.76 | 4.8 | 22.7 | 61.5 | 101 | 198.5 | 273.5 |
| Duration of Positive Phase of the Shock Wave ($\Delta t$) in sec | .69 | 1.88 | 3.53 | 9.58 | 4.4 | 12.25 | 12.65 |

One cannot help notice that some of the physical parameters listed above have the same values for different values of distances and weapon yields. At this juncture, one should be made aware that this is because the corresponding values of the "dimensionless" parameter $D/W^{(\frac{1}{3})}$ are actually identical. Therefore, distance has a vital influence. Two typical weapon yields are selected: 1 and 20 MT (megaton); which represent the practical range of weapons that could most likely be used in a potential attack on most targets. The distances chosen are established to obtain the same values of the static shock wave peak overpressure, for meaningful comparison, also for the reason that strucutural resistance to blast effects is the prime practical consideration for intitial survivability criterion. Blast effects can be identified by a chronological series of events as follows:

1. After a time $t_1$ from the weapon detonation moment, at a given distance D (from ground zero), the shock wave front arrives ($P_{max}$ of FIG. 35). If unhindered by nearby obstacles, the static pressure in that front is felt as a sudden, instantaneous rise in pressure above ambient pressure;

2. Either as time passes (fixed location), or as one would measure pressure along the depth of the shock wave (fixed time), the pressure inside the shock wave drops rapidly as shown in the curve of FIG. 35. It reaches ambient atmospheric pressure (end of the positive phase) and then decreases below that value to start the negative phase, during which the pressure felt is lower than ambient, until time $t_2$, when ambient pressure is finally restored;
3. The shock wave moves at a velocity V and, behind the front, air masses move at a lower velocity U, in the form of a "wind";
4. If stopped by an obstacle on its path, the air mass behind the front "piles up" against that obstacle and a higher pressure is then applied on that obstacle (dynamic pressure); and
5. The air mass has momentum (or exerts pressure for a given period of time on the obstacle surface) and an impulse is delivered to such obstacle surface.

The end result for such obstacle is that of receiving an impulse (or shock), then that of being engulfed in a pressurizing atmosphere, then in a rarefied atmosphere, then that of being exposed to a high velocity wind, if one assumes that the dimensions of the obstacle are small, as compared to the depth of the shock wave. Practically, at distances where structural survivability can effectively be attempted, this is always the case for the size of weapons being considered. For instance, in the case of a 1-MT detonation 6 miles away, the positive phase of the shock wave has a depth of almost 4,000 ft. That distance is of course much larger than any structure dimension of interest. Furthermore, it is obvious that any man-made "obstacle" would have dimensions much smaller than 4,000 ft. Also, a loading duration of possibly a few seconds applied on such structure is more of the nature of a static type of loading than that of a shock loading. For these reasons, man-made structures must be calculated, designed and constructed to withstand external pressures which are to be considered as long duration loads, but applied only in one direction: from the outside inward.

There are two basic approaches to building such structures: rigid enough to withstand the load without failure or flexible and deformable to give in without rupturing and then bounce back also without permanent failure. Both approaches are used in the invention. Economic considerations impose another constraint which is that the cost of construction should not exceed the cost of a standard type one-story residential building, per unit of habitable area, if the structure is intended to provide useful continuous shelter under non-emergency conditions. The rigid strong structure-type buildings are illustrated in FIGS. 1, 2, 3, 4, 5 and 21. The flexible and deformable type of structure is illustrated in FIGS. 11, 12, 13 and 14. Both types can be most advantageously combined to render the overall building complex more attractive and habitable, to provide more space, more light and an impression of outdoor living, while being isolated nevertheless from a hostile and unhealthy environment. A choice must be made of the value of peak overpressure that an affordable construction can successfully withstand if structure designs such as those shown in FIGS. 2, 4, 5 and 21 are used. A value of 2 psi for $P_{max}$ is practical and realistic. The locations of the likely targets for attack by nuclear weapons are well known throughout the nation. The maximum yield that can be realistically anticipated is 20 to 25 MT. The worst combination of values of the applicable factors indicates that the following criteria are realistic and can be used as design guidelines:

1. A distance of at least 15 miles from all ground zeros that correspond to any likely targets in any direction around;
2. A time of arrival of the shock wave of 1 minute; and
3. A duration of the overpressure pulse of 9 seconds.

At this juncture, it should be pointed out that conventional wood frame, one-story residential structures may be partly destroyed by a peak overpressure of 0.5 psi, present dangers (flying broken pieces of glass) as shelter and become practically unhabitable afterward if the explosion generates fallout. The value of 0.5 psi corresponds to a distance (straight line) of 60 miles, encompassing an area 16 times larger than the area delineated by a 15-mile radius; with the difference that, with shelter provided as per the present invention, all people sheltered survive, even in case of fallout, and that few people escape uninjured if not sheltered (and even fewer would survive if there were some fallout). A second point to be made pertains to the use that can be made of such structures and facilities, when they are not used in their primary role of nuclear shelters. Because it is hoped that the need for their use in their primary role will never materialize, a secondary usage is very desirable and economically mandatory.

If one draws 15-mile radius circles around all likely targets within the continental US, one quickly realizes that most centers with heavy population concentrations are enclosed within the areas covered by such circles. This means that the locations of such camp sites are in rural areas with low density population. Because such camp sites and the structures and facilities therein must provide its occupants with all that which is needed for existence under healthy conditions for at least two or three weeks in case of fallout, the camp, its facilities and resources can be used, under non-emergency conditions, as a vacation resort, retreat or the like.

The other design and construction requirement for the structures and the camp is dictated by a threat which is, in most cases very unlikely, in a few other instances very likely, spatially impossible to predict, but more lethal than the blast, should it materialize. That threat is the radioactive exposure caused by fallout debris. The two dependent aspects of fallout are: (1) its likelyhood, before and after the fact; and (2) its predictability, after the fact, of the amount of fallout, in terms of radiation levels, if detection and calculation means are available and if wind velocities and directions are known at the time of the attack. The "fact" refers to a nuclear weapon detonation having taken place. As was mentioned earlier, when the fireball does not reach the ground, no short term fallout is generated. When the fireball touches the ground, depending upon the altitude of the detonation point (above ground level), fallout debris are created and will eventually be deposited later, somewhere else, within several hours. For a given weapon yield and the yield ratio of fusion-to-fission of that weapon, the percentage of fallout debris generated (as compared to the maximum amount, 100%, that would have been generated, had that weapon been exploded at ground level) can vary from 0 (fireball not reaching the ground) to 100% (explosion at ground level). The location and nature of the targets being well known to any potential attacker, according to a logical strategy of maximum and most effective destruction, from a military standpoint, the following is the most likely to happen:

1. Hardened military sites (missile silos and submarine bases) are targeted for ground level detonation;
2. Military and industrial installations of significance need not be targeted for ground level detonation, as they would suffer more extensive damages from an altitude detonation, but still low enough for the fireball to reach the ground; and
3. Civilian centers can suffer the maximum amount of damages (in terms of structures, facilities and lives) from a higher altitude detonation, for a given weapon yield, such that the fireball does not reach the ground, from blast effects. The unknown is whether the potential attacker will decide to trade off less material damage for more human lives, which fallout would undoubtedly cause to happen. For the purpose of the present invention, it is assumed that the possibility of a ground detonation always exists, for any target. However, it is of paramount importance to be able to determine how much fallout, if any, will occur once a nuclear weapon has been detonated within the danger range.

To that effect, light and pressure detectors are located in sensor housing 2 of FIGS. 1 and 14. These detectors are activated when a state of emergency is in effect. For that camp location, with respect to the location of all likely targets, the detectors are aimed at such targets and cover the range of possible angular variations that may exist between the predicted ideal detonation location and the actual location (after the fact) when the event took place. The sensed information is constantly monitored and recorded. To eliminate such extraneous light signals as those created by lightnings, reflections of sun rays, etc . . . , such light signals are compared to a typical light signal emitted by a nuclear detonation, and then ignored if non-conforming. A light signal which meets the typical light signal model from a nuclear detonation, then triggers the start of all camp emergency operations and procedures already programmed to handle the sequence of impending phenomena from which protection is to be provided to the camp occupants. First, the countdown is started to measure time, starting with the event occurence (t=0); second, calculations are initiated to determine the exact spatial location of the detonation; third, the shock wave characteristics are recorded, including time of arrival from time zero; fourth, the weapon yield is calculated; fifth, wind directions and velocities at various altitudes are entered into the computer (those that were known most recently before the detonation); sixth, the computer calculates the amount of fallout debris likely to have been generated; finally, seventh, the computer then calculates the amount and chronological rate of fallout deposition to be expected from that detonation, expressed in radiation levels. The detectors and the computer are still ready to handle signals from any other nuclear detonation and process them.

If fallout is predicted, one must understand and know how to handle fallout. FIG. 36 exhibits a typical curve of radiation levels as a function of time. After time $t_1$, all curves representing fallout decay are identical in shape (exponentials), however, especially before $R_{max}$ is reached, the shape of curve $R=F(t)$ depends upon variables such as wind velocity and direction distributions versus altitude, weapon yield and so on, that can affect the rate of settling of the radioactive debris. However, $R_o$, which corresponds to the peak radiation level that the fallout would have reached, had all the fallout dust fallen at the location considered, at the instant the weapon detonated, can be more easily predicted. In any event, the total amount of radiation to which one would be exposed at a time T after the moment of detonation is the integral under curve $R=F(t)$, and which corresponds to the shaded area under that curve. Because of the faster rate of radioactivity decay when R(t) is high, after a while, the rate of increase of that exposure becomes asymptotic to a plateau which represents the total possible maximum amount of radiation exposure that one could receive at that location, under those conditions, if no protection were provided. Until time t, when the first dust particles start reaching the ground, no radioactivity exists at that location. After all fallout has occurred (after time $t_1$) a rule of thumb can be used to simply predict the radiation level at any time later, it is called the "7-10 Rule". It means that the radiation level (or intensity) becomes one tenth of what it was, at any time, at any time later and which is equal to seven times the value of the time elapsed between the instant of detonation and the time at which the measurement was made. For instance, if R=1000 units after four hours from time zero, it will be only 100 units, 24 hours later, or 28 hours from time zero.

FIG. 37 indicates how the location of the point of detonation is determined. Probe 11 mounted on support 12, inside housing 2 of FIG. 1, is articulated on joint 14 so that the axis of cone 23 can be oriented in the direction (line of sight) of the target to be monitored by that probe as shown by arrow f. Within cone 23, a plurality of tubes 16, painted black inside, terminate at the front end 24 of proble 10, where the end of each tube contains a photoelectric cell. Because of the high instantaneous light flux to be sensed, light filters may be located in front of the photoelectric cells. Each cell sends its own signal and all signals are channelled by lead 18 to the monitoring, recording and computing system. The solid angle $\beta$, covered by such probe is wide enough to account for the anticipated range of variations in the point of detonation location, for the target monitored by that probe. The signals received by one probe, when plotted as a function of $\beta$, as illustrated in FIG. 38, may yield a curve such as that shown by the solid line, whereas, the anticipated ideal curve is that shown in phantom line (Model). The location of $\phi_{max}$ (maximum light flux), at an angle $\beta_1$ away from the reference location $\beta=0$, indicates the the actual location of the detonation point X in the plane of FIG. 37. Since cone 23 is only the projection of a solid cone, as mentioned earlier, another angle $\beta_2$ can also be obtained in a plane perpendicular to the plane of FIG. 37 which also passes through the probe centerline. The exact angle of the actual line of sight of the detonation is then spatially known.

The base of cone 23, of diameter $\Delta$, is rather small for each target and, if targets are relatively close, one probe with a wider conical coverage can monitor more than one target. The actual shape of curve $\phi(x)$, calculated from the signals received, may vary greatly from the shape of the anticipated model, especially because weather conditions may be very adverse to good light transmission (clouds, fog, rain, snow), which may tend to flatten the curve, because of light diffraction. This is another reason for making $\Delta$ much larger than needed under ideal conditions. Hoever, the peak $\phi_{max}$, thereby $\beta_1$ (and $\beta_2$) and point X, should always be identifiable. From time $t_1$ on, the radiation intensity is monitored and measured to determine the values of $R_{max}$ and the time at which it occurs, in an area located away from the camp occupants, where a small amount of radioactive fallout dust can safely be left undisturbed. Washing off or vacuuming of the fallout dust within the camp cannot be postponed for too long and should be started before $R_{max}$ is reached.

If there is fallout, there are only three ways available to lower and minimize the total exposure of the camp occupants to radiations: (1) Shield the occupants from the source of radiations; (2) Remove most of the radiation source quickly enough and relocate it farther away (which corresponds to creating distance between the source and the occupants); and (3) Wait until the radioactivity level in the region has decayed to a level safe enough to permit the few hours of exposure needed for safe evacuation to a non-polluted area, far away, or until such time when normal living conditions can be resumed in and around the camp. Actually, all three ways are used to the utmost practical degree. Shielding is provided by walls about the camp, by the depth of the dump wells and the amount of dirt 173 or filtering sand mounds 169. Removing the nearby source of radiation is done by either washing the fallout dust off the building roofs and walls, the ground within wall 90 boundaries, or clean vacuuming these surfaces if the ambient temperature do not permit the use of water mixtures with a low freezing point. Waiting is made possible by having an organized camp equipped, staffed and supplied to operate for several weeks, autonomously from the outside world.

If there is no fallout and if the probability of further nuclear attacks no longer exists, the occupants have survived fully unharmed. They remain in the camp, if they so choose, if the probabiltiy of another attack still exists. If there is heavy fallout, means are provided by the present invention to keep the total radiation exposure of the occupants below a harmful level for at least one heavy fallout occurence. Only deep underground shelters could provide better fallout protection in such case.

The curve shown in FIG. 35 represents the variation of pressure above ambient along the depth of the shock wave and the values of pressure and time given previously in the table of characteristics apply only in the case of an ideal air volume where initial pressures are equal ahead of the shock wave and where no part of the shock wave is disturbed. Practically, because the distances traveled by the shock wave are large compared to the detonation altitude and because the shock wave may travel along uneven surfaces (mountains and valleys), the front of the shock wave will be less abrupt and the value of the front peak pressure will also be lower than those depicted in FIG. 35. The combination of these three factors: (1) decrease of atmospheric pressure with altitude; (2) altitude of the detonation point; and (3) nature of the terrain and topography of the region; affect the shape of and prressure values in the frontal part of the shock wave, but certainly by less than a factor of two. The combination of all other uncertainties (weapon yield, camp site altitude and orientation, etc . . . ) can cause errors in prediction of at least that much, therefore, the theoritical curve of FIG. 35 can still be useful and meaningful as a model. Because the overpressure falls off rapidly behind the shock front and structures have a response time which is appreciable with respect to the duration of the overpressure phase, the actual meaningful "static" pressure to which rigid structures would have time to respond (for intance in the local buckling mode) is more like that shown in phantom line in FIG. 35 and is called $P_{actual}$. This actual pressure, for the practical application described in the present invention, is probably between 70 and 75% of $P_{max}$. However, the pressure sensors detect $P_{max}$ and $P_{max}$ is used in the calculation of the weapon yield. Curved shells of the shape shown in FIG. 2, with a lateral span of 30 ft, constructed with a shell 6-inch thick and well anchored, as shown in FIG. 21, can withstand external pressures of 2 psi indefinitely. The 6-inch thick shell, as an example, can consist of two stainless steel sheets, 0.032-inch thick, bonded to a core of light plastic rigid foam located between the two steel sheets. Thicker plastic sheets can also be used instead of stainless steel. The advantage of at least the external sheet being of a metallic nature is to provide a Faraday cage protection against any electromagnetic pulse generated by a high altitude detonation of a nuclear weapon, intended or not.

The flexible deformable dome-shaped structure 157 of FIG. 1, has a much lighter weight per unit area and has no rigidity. Therefore, as the pressure builds up externally when the shock wave passes by, the dome caves in because the rigidity provided by the inflated ribs 162 of FIG. 12 can offer no significant resistance to such caving in motion. The dome anchoring ring does not move, but sliding sleeve 166 leaves stop flange 170, bringing down connecting ring 164 with it because it is guided down by mast 168 external surface. The surface of dome 157 consists mostly of transparent plastic sheets or membranes 178, located between flexible inflated ribs 162, and lighter than ribs 162. These membranes move down ahead of ribs 162, being lighter. Their curvature between ribs 162 and the downward motion of sliding sleeve 166, together, cause a decrease of the volume inside and underneath dome 157. An alert is sounded when the weapon detonation flash occurs and all doors connecting the rigid structure buildings to the dome area are closed, after all occupants have left this area and are on the way to their individual units or to other sheltered common areas. In any case, all camp occupants are instructed to be within the confines of rigid structure buildings within one minute from the sounding of an alert. The air within the space under the dome is trapped and the pressure therein increases to match the external pressure exerted on the dome roof, which very quickly is down to a fraction of the shock wave front peak pressure. The sudden rise in pressure inside the dome would not affect any occupant left in the dome area, because the rate of pressure increase there would be infinitely slower than the pressure rise in the shock front. Soon after, the dome roof goes back up and becomes pressurized internally when the underpressure phase of the shock wave passes by. It is likely that any occupant left there would not feel that depressurizing phenomenon. Within a fraction of a minute, the dome roof has resumed its normal shape and position. Sliding sleeve 166 is back to its rest position against stop flange 178 and never goes beyond this point. During the rarefaction period (underpressure phase), the dome roof membranes may bulge between ribs 162, but without stretching the plastic sheets beyond the elastic point of the material. After the shock has passed by, if no other detonation has been detected in the region, the doors connecting the rigid structure buildings to the dome space can be opened again. By then, some indication should be available as to whether some fallout is anticipated from that explosion. If so, all doors opening on the outside and all windows, which had already been closed at the time of the alert automatically, are now locked. All events to the outside are shut and locked. Glass is not used any place in the complex for transparent surfaces. It is too fragile and dangerous. Polycarbonate sheets are used instead. They all are given a slight convex curvature (bulging out) to strengthen them even more.

In case there is any indication that some fallout may occur, either the dust washing or the vacuum cleaning equipments are readied and put in place so that they can be used as soon as fallout starts to materialize. Dump well caps and quick connect/disconnect plug covers (as applicable) are removed. There is at least one, posssibly two hours available for the personnel to remain outside to complete preparations, without danger, before fallout dust starts coming down. As soon as this manifests itself, all camp occupants and personnel, for safety reasons must thereafter be confined indoor. Nobody can be allowed outside for days, possibly for a few weeks, unless a case of extreme emergency justifies it. The total amount of radiation exposure received by anyone going outside is carefully recorded and monitored, to keep the cumulative radiation dosage received by that individual below the minimal danger level. As a rule, after fallout has started, all operations outside the buildings are conducted by remote control. The operation of the vacuum cleaning system is described earlier and need no additional discussion. However, it should be pointed out that the feedback information received by the operators of all remotely controlled equipment is by visual observation only, through either the windows or the transparent plastic sheets of dome 157 of FIG. 13. All parts of the whole complex can be seen either from the windows or through the dome roof. If and when washing off the dust is possible, in addition to the sprinkler system described peviously, mobile water tanks equipped with sprinkling spouts, also operated by remote control, are available to reach those spots not adequately reached by the fixed sprinklers. From inside the buildings, the level of radioactivity is measured and constantly monitored by personnel, to locate these pockets of radioactive dust outside, from the inside.

Vacuum cleaning of the dome roof is not practical and if washing off the dust is not possible (subzero weather), two cleaning means can then be used effectively: (1) tapping flexible sheets 178 and ribs 162 from the inside, mechanically with a vibrator operated from the ground floor level, and (2) jets of compressed air from nozzles located above stop flange 170, to blow the fallout dust further down on the side of dome 157. Means (1) and (2) above can easily be combined. Also, a coating of dust repellent, possibly combined with electrostatic repulsive means, can be applied on the external surface of dome 157 during the safe one-hour period after the weapon detonation. Another method consists of a thin film of plastic coated with a dust repellent which can be laid on top of dome 157 during the one-hour preparation period. In case the radioactive dust is slightly charged electrically, electrostatic repelling means can also be used from inside the dome. The plastic film earlier mentioned can also be covered on the outisde with a sticky coating to which the dust adheres. After a few hours, when most of the dust has settled, this film can be removed mechanically by remote control through means well known in the art of remote control operation. The removed film can then be disposed of in a dump well or outside the camp grounds.

Prior to a nuclear detonation flash being detected, the camp most likely operates with power and utilities provided by a public utility company. However, such public utility company plants would most probably be destroyed by the attack. Means are therefore provided within the camp to shut off all sources of external supplies automatically, as soon as the detonation flash is detected. At the same time, the camp facilities are immediately switched on. In the case of electrical power, the switch is made before that: as soon as the emergency condition has been instituted. This is to prevent the current surge generated by the electromagnetic pulse (if any) from damaging the camp electrical system. For additional safety, other contacts such as telephone lines can also be cut off under emergency conditions, for the same reason. However, the availability and performance of public utility sources are constantly monitored during the switching off period, so that the camp can be switched back on to the public utility services, should it appear to be safe and judicious, after a while.

The means for providing the services and accomodations to the occupants and the personnel of the camp are not described. They are such that all people inside the camp are given the care needed to keep confined people mentally and physically healthy. All activities are programmed and conducted, under such emergency conditions, on a community basis: feeding, exercizing, counselling, etc . . . Everything is done and meant to make a confinement period of up to several weeks as bearable as possible under such circumstances. In addition, programs and activities are scheduled and organized to prepare the camp personnel and occupants to ready themselves for the tasks that await themm outside where survivors who lived through the ordeal, but less fortunate in being able to survive uninjured and unharmed, need help desperately to be able to cope and then in turn to help others.

Because the effects of exposure to radiations on living cells are cumulative, if the total exposure occurred during a short period of their life span, and because a certain amount of total irradiation can be accumulated safely during a lifetime, personnel can accumulate that total dose of radiations, during the ordeal. A total considered safe for healthy adults, under the unusual circumstances created by a nuclear attack, is about 100 rads. Under normal circumstances, such level should not be considered safe however. This means that, in case of extreme emergency, if there is some fallout, some camp personnel can leave the relative shelter of the buildings to go outside to perform some tasks of vital importance and urgency. Also, personnel can take turns to complete such unscheduled assignments, so that the risk is shared by all personnel and thereby minimized for each of its members. All personnel and other camp occupants are required to wear radiation dosage badges, monitored as frequently as deemed necessary by the management. Such precautions are required only in case of appreciable fallout.

The survivability, and its desirability, of a nuclear war are highly controversial and emotional subjects that cannot be discussed here. Too many aspects of any of its many facets can be argued both ways, pro and con, by parties opposing each other but who have the same aim nonetheless: MINIMIZE THE RISK OF SUCH A GLOBAL CATASTROPHY EVER TAKING PLACE. Opinions differ only as to what should be done and how it should be done. That difference of opinion by itself could be enough to cause a war. There is no concensus of opinion, either, as to what the long term consequences of a nuclear war would be. However, if attempting to make it easier for more people to survive, and under better conditions, with the minimum of lasting health hazards, is deemed a desirable and valuable feature of such attempt, the present invention provides the means to make this possible on a scale larger and at a cost lower than would be possible with deep underground shelters or individual suburban shelters.

It is mandatory that people attempt to survive as large size groups, well organized and well prepared. The problems that would face the survivors, especially those who survived under ideal circumstances, are awesome, both in terms of numbers and complexity. As a group, they will have the only chance to optimize their state of readiness before the attack, immediately after the attack and much later, when able survivors are badly needed to help others and make living possible again on earth. The traumas to deal with would not be only of a physical nature, but more importantly, of mental, psychological and social natures. Only people in large groups, well prepared, well organized and well balanced in terms of individual capabilities can have a chance to succeed in being of effective assistance to others, fast enough to be useful. The subjects of financial participation, group organization, management, defense, planned assistance to others, prealert warnings, logistics and storage of supplies, communications with the outside after an attack, etc. . . . , are neither described nor discussed here. They are deemed to be beyond the scope of and are not considered part of the present invention.

The present invention, however, presents the features, means and characteristics that are essential to and required by the implementation of such an attempt at survivability. It is unfortunate that, for the first time in modern history, individuals, on scales never before imaginable, for such a brief period of time, must count only on themselves if they wish to attempt meaningfully to survive the evil of forces unleashed by their officials. Unless and until those individuals who elect to attempt such meaningful survival have at their disposal the means to try, such attempt is hopeless and doomed. The present invention offers the necessary first step in that direction.

Having thus described my invention, I now claim:

1. A nuclear war group survival camp including a combination of structures, facilities, equipment and other camp site improvements and further comprising:

means for protecting people inside structures located above ground against the effects of blast caused by the explosion of a nuclear weapon, on and above ground, within a distance that would create a lethal environment inside any conventionally constructed building structure at such distance;

means for removing fallout debris (dust) generated by said explosion in a manner such that the total radiation dosage received by any and all so sheltered people remains below the radiation dose level considered critical, whereby none of said people will suffer of radiation sickness, until the fallout radiation level outside the camp has decayed down to a safe level;

means for providing adequate healthy physical and mental surroundings to said people during all of their forced confinement;

means for providing such shelter, living conditions and survival chance to a large group of people, in each camp, and in a manner such that no group member is isolated from the body, protection and support of said group, during all of the confinement period;

means for safely and reliably disposing of the radioactive fallout dust in a manner such that said dust cannot be hazardous to the population residing outside the camp;

means for enhancing the ability of the group to defend and protect itself against bands of marauding ill-intentioned elements of the population outside the camp site, after a nuclear emergency has been declared;

means for preserving communication means with and rendering assistance to the population outside the camp who also survived, but may be in dire need of help;

remotely controlled means for vacuuming fallout dust within the camp periphery;

means for driving and steering said remotely controlled means by radio;

means for creating vacuum suction into an in-place network of vacuum suction tubes positioned throughout the camp;

means for connecting said remotely controlled means to electrical power connectors and in-place vacuum system connections;

means for brushing off systematically and automatically all external surfaces located within the camp periphery;

means for dumping the fallout dust into shielded wells located strategically throughout the camp site;

means for evacuating the collected fallout dust into a network of dust evacuation pipes; and means for trapping the fallout dust being evacuated inside filtering said mounds located outside the camp boundary and constructed to provide radiation shielding on the side facing the camp.

2. A nuclear war group survival camp according to claim 1 wherein the means for enhancing the group ability to defend and protect itself includes a water-filled moat located outside a wall surrounding the camp, and further comprising:

means for shielding the camp occupants against the fallout dust radioactivity emanating from beyond the camp boundary;

means for utilizing the moat water to wash off the fallout dust within the camp periphery; and means for storing the washed off fallout dust under water in said moat;

whereby the fallout dust is enabled to settle at the bottom of said moat, thereby enabling the water above the settled dust to provide a shield against the washed off radioactive dust.

3. A nuclear war group survival camp according to claim 2 wherein all external surfaces within the camp periphery are arranged to prevent the formations of cavities and to facilitate the draining of water off said surfaces, and further comprising:

means for sprinkling water on all said external surfaces during the fallout period; and means for evacuating the sprinkled water containing the washed off fallout dust back into the moat.

4. A nuclear war group survival camp according to claim 1 further comprising:

means for detecting the altitude and location of a nuclear weapon detonation within approximately one hundred miles;

means for sensing the shock wave generated by such explosion and for measuring its characteristics as it passes by;

means for monitoring the wind and weather conditions at all times, within a few hundred miles from the camp;

means for evaluating the yield and nature of the exploded weapon; and means for calculating and predicting the amount of fallout and the time of arrival of its onset.

5. A nuclear war group survival camp according to claim 1 further comprising means for measuring the radioactivity level of the fallout dust and its rate of deposition;

means for calculating and monitoring the radiation exposure dosage during the period of the occupants confinement, inside the living quarters; and means for monitoring the radiation dose received by each and every occupant of the camp from the time of the first fallout manifestation.

6. A nuclear war group survival camp according to claim 1 wherein the fallout dust located within the periphery of the camp site is washed off the ground and off the building walls and roofs automatically and by remote control, until fallout has ceased, by means of in-place sprinkling systems.

7. A nuclear war group survival camp according to claim 1 wherein all living quarters are protected by and are located inside a rigid structural shell comprising means for resisting and absorbing the effects of the explosion-generated shock wave, whereby the occupants of said quarters feel none of the effects of said shock wave;

means for anchoring said rigid structural shell to the building foundations;

means for closing and locking all windows and doors affixed to said rigid structural shell automatically when an emergency condition has been established (detected nuclear explosion);

means for being washed and vacuumed cleaned externally; and means for providing, externally and internally, electrical and vacuum connections.

8. A nuclear war group survival camp according to claim 1 wherein some common and service quarters are protected by and and located inside a flexible structure comprising means for erecting and stiffening a flexible deformable membrane and for deploying said membrane over the area of the quarters to be protected;

means for anchoring said flexible structure to the surrounding rigid structural shells, in an air-tight manner;

means for deforming freely under external ambient pressure, while being guided and partly restrained during said deformation and the bouncing back phase following the initial deformation inward after a shock wave has gone by; and means for being washed and cleaned externally of fallout dust settled on it.

9. A nuclear war group survival camp according to claim 7 wherein all transparent surfaces located on and being part of the rigid structural shell are shock resistant and made of polycarbonate material, thereby preventing the risk of fracturing and resulting dangerous hazards to the camp occupants.

10. A nuclear war group survival camp according to claim 1 wherein means is provided for generating power for the camp use after a state of nuclear-attack emergency has been declared and for switching on said generating power means automatically whenever a nuclear explosion has been detected, and for switching off simultaneously the connection with the utility company power source being normally used.

* * * * *